US009500034B2

(12) United States Patent
Holtz et al.

(10) Patent No.: US 9,500,034 B2
(45) Date of Patent: Nov. 22, 2016

(54) BOTTOM HOLE ASSEMBLY WITH WEARABLE STABILIZER PAD FOR DIRECTIONAL STEERING

(71) Applicant: Halliburton Energy Services, Inc., Houston, TX (US)

(72) Inventors: Stephen Robert Holtz, Littleton, CO (US); Keith Holtzman, Arvada, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 47 days.

(21) Appl. No.: 14/424,553

(22) PCT Filed: Apr. 17, 2014

(86) PCT No.: PCT/US2014/034535
§ 371 (c)(1),
(2) Date: Feb. 27, 2015

(87) PCT Pub. No.: WO2015/160354
PCT Pub. Date: Oct. 22, 2015

(65) Prior Publication Data
US 2016/0230465 A1 Aug. 11, 2016

(51) Int. Cl.
*E21B 7/06* (2006.01)
*E21B 17/10* (2006.01)
*E21B 49/00* (2006.01)

(52) U.S. Cl.
CPC ..... *E21B 7/061* (2013.01); *E21B 17/1078* (2013.01); *E21B 49/00* (2013.01)

(58) Field of Classification Search
CPC ..... E21B 7/061; E21B 17/1078; E21B 49/00
See application file for complete search history.

(56) References Cited

U.S. PATENT DOCUMENTS

| | | | | |
|---|---|---|---|---|
| 3,154,156 | A | 10/1964 | Moore et al. | |
| 3,298,449 | A | 1/1967 | Bachman et al. | |
| 3,974,886 | A | 8/1976 | Blake, Jr. | |
| 4,185,704 | A | 1/1980 | Nixon, Jr. | |
| 4,379,494 | A | 4/1983 | Sheshtawy | |
| 4,668,117 | A | 5/1987 | Bair | |
| 4,938,298 | A | 7/1990 | Rehm | |
| 5,090,496 | A | 2/1992 | Walker | |
| 5,094,304 | A | 3/1992 | Briggs | |
| 5,419,405 | A * | 5/1995 | Patton | E21B 7/04 175/27 |
| 5,467,834 | A | 11/1995 | Hughes et al. | |
| 5,857,531 | A | 1/1999 | Estep et al. | |
| 5,887,655 | A | 3/1999 | Haugen et al. | |
| 5,979,571 | A | 11/1999 | Scott et al. | |

(Continued)

OTHER PUBLICATIONS

International Search Report and Written Opinion of the International Searching Authority issued in International Application No. PCT/US2014/034535 on Jan. 26, 2015; 17 pages.

*Primary Examiner* — William P Neuder
(74) *Attorney, Agent, or Firm* — Alan Bryson; Parker Justiss, P.C.

(57) ABSTRACT

A wearable stabilizer pad and method of directionally drilling a wellbore is disclosed. The wearable stabilizer pad is mounted on a component of a bottom hole assembly. The component of the bottom hole assembly is rotated in the wellbore thereby wearing the stabilizer at a predetermined wear rate by contacting the wellbore wall. Wearing of the stabilizer at the predetermined wear rate as it rotates and contacts the wellbore wall steers the bottom hole assembly in a curve portion of the wellbore.

19 Claims, 9 Drawing Sheets

(56) References Cited

U.S. PATENT DOCUMENTS

| | | | |
|---|---|---|---|
| 6,702,046 | B2 | 3/2004 | Webb et al. |
| 7,013,992 | B2 | 3/2006 | Tessari et al. |
| 7,334,650 | B2 | 2/2008 | Giroux et al. |
| 7,661,488 | B2 | 2/2010 | Andoskin et al. |
| 7,953,586 | B2 | 5/2011 | Chen et al. |
| 2004/0231854 | A1 | 11/2004 | Slack |
| 2007/0163810 | A1 | 7/2007 | Underwood et al. |
| 2008/0230272 | A1 | 9/2008 | Chen et al. |

* cited by examiner

800

900

1000

BOTTOM HOLE ASSEMBLY WITH WEARABLE STABILIZER PAD FOR DIRECTIONAL STEERING

CLAIM OF PRIORITY

This application is a 371 U.S. National Stage Application of and claims the benefit of priority to International Application No. PCT/US2014/034535, filed Apr. 17, 2014 and entitled "Bottom Hole Assembly with Wearable Stabilizer Pad for Directional Steering", the contents of which are hereby incorporated by reference.

TECHNICAL FIELD

This disclosure generally relates to a tool and method for steering the drill string during drilling operations using a wearable stabilizer pad on the bottom hole assembly.

BACKGROUND

Directional drilling is a process in which the direction in which a wellbore is formed is controlled during drilling. Directional drilling permits wellbores to access specific targets where it would be difficult or impossible to use vertical drilling equipment, such as underground reserves that lie directly beneath surface areas under municipalities, lakes, or other natural or manmade features. Directional drilling also allows multiple wellheads to be grouped together, with the wellbores extending away from the group in various directions underground such as on an off shore platform. Directional drilling is also used to form a near horizontal portion of a wellbore that intersects a greater portion of a petroleum reservoir than a vertical wellbore would penetrate thereby increasing the drainage efficiency of the wellbore.

One general type of directional drilling involves the use of a downhole mud motor having a bent motor housing coupled to the drill string. The drill bit at the end of the drill string may be rotated either by rotating the entire drill string from the surface, or by rotating just the drill bit using the mud motor housing. When rotating the entire drill string from the surface, the bent motor housing rotates along with the rest of the drill string, to drill a nominally straight wellbore section. By ceasing rotation from the surface and rotating the drill bit using just the downhole mud motor, a deviated section is formed at an angle determined by the bend in the motor housing (a process known as "sliding").

Another type of directional drilling involves the use of a rotary steerable drilling system that controls an azimuthal direction and/or degree of deflection while the entire drill string is rotated continuously. Rotary steerable drilling systems typically involve the use of an actuation mechanism that actively causes the drill bit to deviate from the current path using either a "point the bit" or "push the bit" mechanism. In a "point the bit" system, the actuation mechanism is controlled to deflect and orient the drill bit to a desired position by bending the drill bit drive shaft within the body of the rotary steerable assembly. As a result, the drill bit tilts and deviates with respect to the borehole axis. In a "push the bit" system, the actuation mechanism is instead controlled to selectively push the drill string against the wall of the borehole, thereby offsetting the drill bit with respect to the borehole axis. Yet another directional drilling technique, generally referred to as the "push to point," encompasses a combination of the "point the bit" and "push the bit" methods.

DETAILED DESCRIPTION

Figure 1:
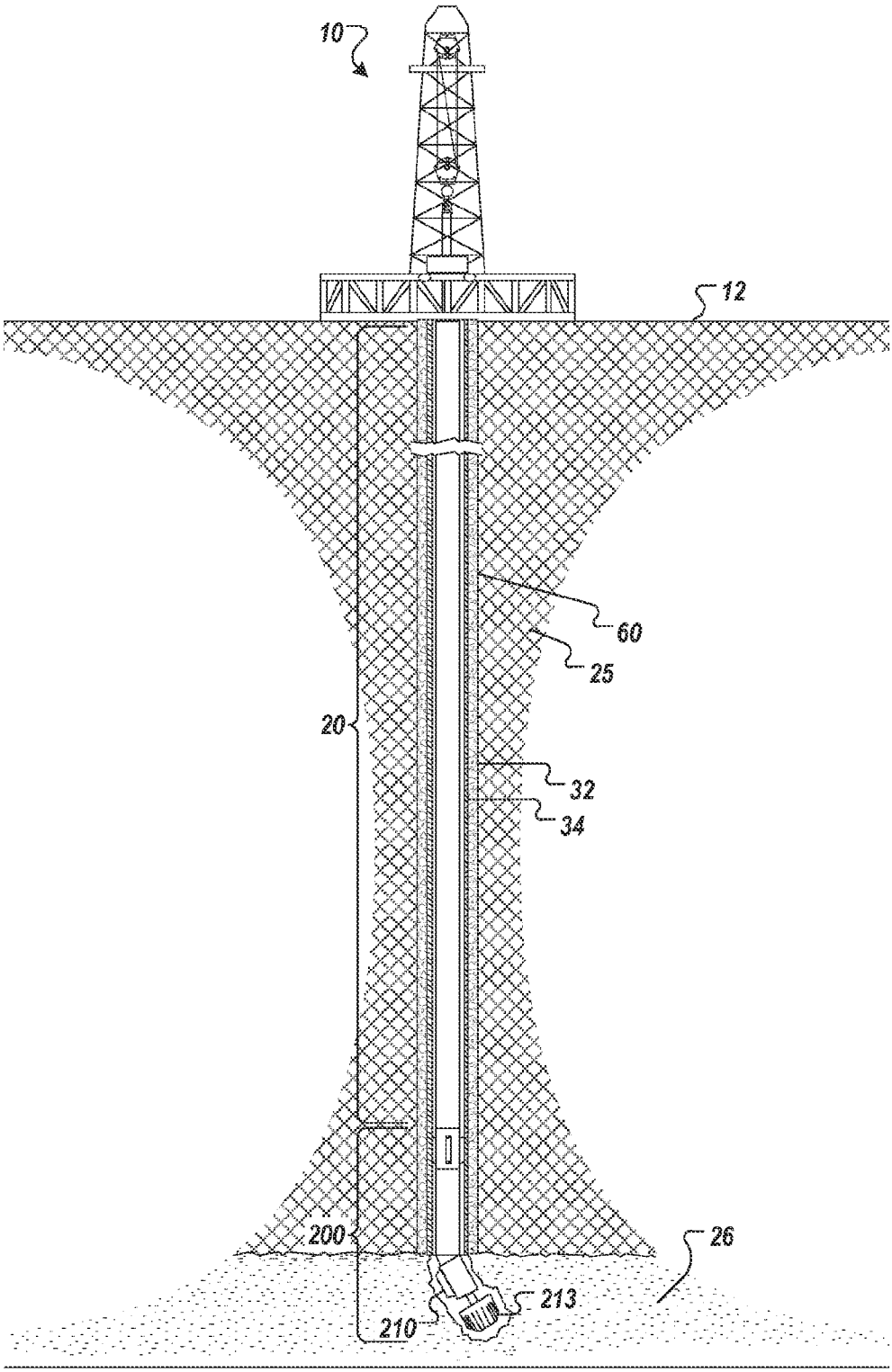
FIG. 1 illustrates an example directional drilling system.

Systems and methods are disclosed involving directional drilling, whereby wearable stabilizer pads are strategically configured in a manner that improves both the drilling of a deviated wellbore section and the resulting quality of the deviated wellbore section. Whereas conventional stabilizers blades are formed of hard materials and include hard facing deliberately applied to resist wear, the disclosed stabilizer pads include portions that are intentionally designed to wear, to manipulate and vary the resulting wellbore curvature that occurs when drilling a planned deviated wellbore trajectory.

As used herein, "wellbore curvature" is a measure of the change in a well's trajectory, which in some cases may be a 3-dimensional change in a well's trajectory. There are known industry equations for determining certain aspects of wellbore curvature sometimes referred to in the industry as the "dogleg severity" between two points along the wellbore path (e.g., survey stations). Other related terms include "dogleg output" which is the result attained by drilling with a steerable BHA and "dogleg capability" which is a measure of steerable BHA's ability to achieve a certain dogleg output.

Dogleg Severity Equation.

$$\text{Dogleg Severity (DLS)}=\{\cos^{-1}[(\cos I1\times\cos I2)+(\sin I1\times\sin I2)\times\cos(Az2-Az1)]\text{MD})$$

Where;

DLS=dogleg severity in degrees/100 ft

MD=Measured Depth between survey points in ft

I1=Inclination (angle) at upper survey in degrees

I2=Inclination (angle) at lower in degrees

Az1=Azimuth direction at upper survey

Az2=Azimuth direction at lower survey

Example for dogleg severity based on Radius of Curvature.

Survey 1
Depth=7500 ft
Inclination=45 degree (I1)
Azimuth=130 degree (Az1)
Survey 2
Depth=7595 ft
Inclination=52 degree (I2)
Azimuth=139 degree (Az2)

$$\text{Dogleg Severity (DLS)}=\{\cos^{-1}[(\cos 45\times\cos 52)+(\sin 45\times\sin 52)\times\cos(139+130)]\}\times(100\div 95)$$

$$\text{Dogleg Severity (DLS)}=10.22\ \text{degree}/100\ \text{ft.}$$

As further explained below, for instance, the stabilizer pads may include special materials, material geometries, and positioning, to wear at a predictable rate in view of expected geological characteristics of one or more formations or discrete strata in a formation being drilled using a bottom hole assembly including the wearable stabilizer pads of this disclosure. Just as an example, if the expected geological characteristics identified include upper strata of a particularly soft formation, with a lower strata having a greater hardness, the stabilizer pads may be configured with a geometry that initially provides a somewhat aggressive wellbore curvature through the softer, upper strata. The stabilizer pads may further be formed of a softer, wearable stabilizer pad material that is designed to wear appreciably; such that the wellbore curvature is reduced a desired amount by the time the wellbore reaches the harder, second strata. More specifically, the pad geometry and materials may be configured to maintain a desirable wellbore curvature, e.g., 10-12 degrees per 100 feet, throughout the drilling process, despite the change in formation properties when advancing through the upper strata to the lower strata.

As will be appreciated by one of ordinary skill in the art, the disclosed concepts may be adapted for use in a directional drilling system that uses either a downhole mud motor with bent motor housing or a rotary steerable drilling system.

Referring to FIG. 1, in general, a drilling rig 10 located at or above the surface 12 rotates a drill string 20 disposed in a wellbore 60 below the surface. The drill string includes a bottom hole assembly ("BHA") 200 attached to the lower end of the drill string 20. The wellbore 60 may be reinforced by a casing 34 and a cement sheath 32 in the annulus between the casing 34 and the borehole. The wellbore penetrates one or more geological formations 25 and 26. Each of the geological formations may include one or more discrete strata.

In general, and as will be discussed further in the remainder of this document, the BHA 200 includes one or more wearable stabilizer pads 210 that extend radially outward from the BHA 200 to contact the strata of the subterranean geological formation 26 to steer the BHA 200 along a planned deviated wellbore trajectory, e.g., predetermined curved path for a predetermined distance. As noted above, the stabilizer pads may be adapted for use in a directional drilling system that uses either a downhole mud motor with bent motor housing or a rotary steerable drilling system. To reduce or avoid the possibility of having to periodically trip out to change out the stabilizer(s) used in the directional drilling system to achieve different dogleg capabilities, the stabilizer pads are instead configured to wear at a predictable rate, according to expected geological variations in the strata and formations being drilled. For example, such stabilizer pads can be used in horizontal drilling applications in which a vertical wellbore drilling trajectory needs to be deviated to become a horizontal wellbore drilling trajectory. In other implementations the disclosed concepts may be used when the wellbore trajectory incudes a curve section followed by a tangent section.

Figure 2A:
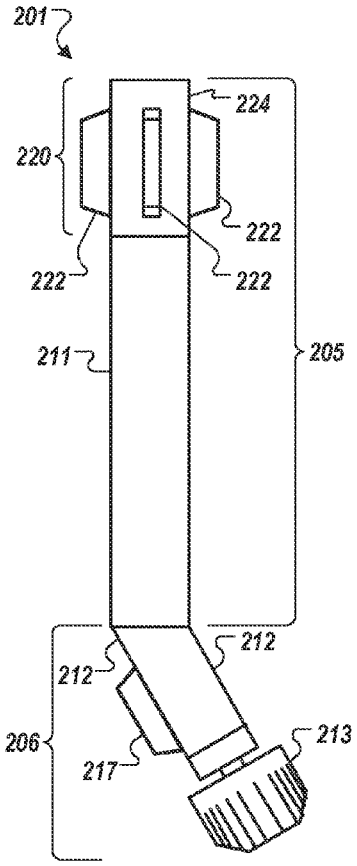
FIG. 2A is a side view of an example bottom hole assembly with an example stabilizer pad in accordance with aspects of the present disclosure.

FIG. 2A is a side view of an example bottom hole assembly 201 of the type that uses a bent motor housing as discussed above. In some embodiments, the BHA 201 can be the BHA 200 of FIG. 1. The BHA 201 includes an upper section 205 and a lower section 206. The upper section 205 includes a stabilizer section 220 and downhole drilling motor 211. The lower section includes a bent motor housing 212 and a drill bit 213. In some embodiments, the motor 211 can be a positive displacement motor, such as a Moineau motor powered by the flow of drilling fluid that is being pumped down the drill string.

A stabilizer pad 217 extends radially outward from the bent motor housing 212. In use, the stabilizer pad 217 extends radially to contact a side wall of the wellbore in a like manner as is illustrated with regard to pad 210 in FIG. 1. Contact between the sidewall and the stabilizer pad 217 orients the BHA 201 at an angle. The angle may have a predetermined value based on the initial geometry of the stabilizer pads 217. The angle caused by contact between the sidewall and the stabilizer pad 217 causes the drill bit 213 or other cutting tool attached to the BHA 201 to drill in an orientation that causes a predetermined deflection (e.g., curved portion sometimes referred to in the industry as a dogleg) in the trajectory (path) of the wellbore 60 as it is being drilled. The construction and use of the stabilizer pad will be discussed further in the descriptions of FIGS. 3-10.

In some embodiments, the stabilizer pad 217 can be integrally formed as a component of the BHA 201. For example, the stabilizer pad 217 may be molded, cast, machined, or otherwise formed along with a component of the BHA such as the bent motor housing 212 as a unitary assembly. In some embodiments, the stabilizer pad 217 can be attached to the bent motor housing 212 or any other appropriate component of the BHA by a bonding agent, such as a catalyst and resin, or an adhesive. In some embodiments, the stabilizer pad 217 can be attached to a component of the BHA by welds, compression fittings (e.g., dovetail fittings), fasteners (e.g., bolts, screws, clamps), or any other appropriate technique or apparatus for removably or fixedly connecting the stabilizer pad 217 to the BHA.

The upper section 205 includes a stabilizer section 220. The stabilizer section 220 includes a collection of stabilizer pads 222 extending radially from a stabilizer body 224. The stabilizer pads 222 may be formed of a relatively durable material (e.g., steel, tungsten carbide) to provide stability to the BHA 201. In some embodiments, one or more of the stabilizer pads 222 may include a wearable portion and a hardened portion more resistant to wear, or may have different layers of differing hardness and wear resistance as will be discussed further in the description of FIGS. 6 and 7. In some embodiments, the stabilizer body 224 can be formed as a cylindrical collar having a diameter large enough to slip over a section of the BHA 201. In some embodiments, the body 224 can be formed as a component that is removably connectable to the BHA 201.

Figure 2B:
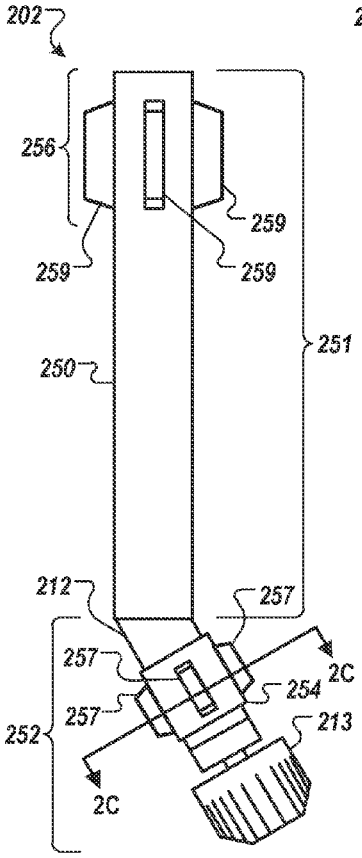
FIG. 2B is a side view of an example bottom hole assembly with an example stabilizer pad sleeve in accordance with aspects of the present disclosure.

FIG. 2B is a side view of an example bottom hole assembly 202 also of the bent motor housing type with an example stabilizer pad sleeve 254 positioned on the bent motor housing 212. In some embodiments, the motor 250 can be a positive displacement motor, such as a Moineau motor.

One or more stabilizer pads 257 extend radially outward from the sleeve 254 positioned on the bent housing 212. In use, at least one of the stabilizer pads 257 contacts a side wall of the wellbore. In a like manner, as discussed previously with regard to FIGS. 1 and 2A, contact between the sidewall and the stabilizer pad 257 orients the BHA 202 at a predetermined angle, which causes the drill bit 213 or other tool attached to the BHA 202 to bore in an orientation that causes a predetermined deflection (e.g., curve, dogleg) in the path of the wellbore 60 as it is being drilled. In some embodiments, the stabilizer pads 257 can be integrally formed as a component of the sleeve 254. For example, the stabilizer pads 257 may be molded, cast, machined, or otherwise formed along with the sleeve 254 or any other appropriate component of the BHA as a unitary assembly. In some embodiments, the stabilizer pads 257 can be attached to the sleeve 254 or any other appropriate part of the BHA by a bonding agent, such as a catalyst and resin, or an adhesive. In some embodiments, the stabilizer pad 257 can be attached to the BHA by welds, compression fittings (e.g., dovetail fittings), fasteners (e.g., bolts, screws, clamps), or any other appropriate technique or apparatus for removably or fixedly connecting the stabilizer pad 257 to the BHA.

The upper section 251 includes a stabilizer section 256. The stabilizer section 256 includes a collection of stabilizer pads 259 extending radially from the upper section 251. The stabilizer pads 259 may be configured and made from materials in a manner as discussed previously with regard to stabilizer pads 222 of FIG. 2A.

Figure 2D:
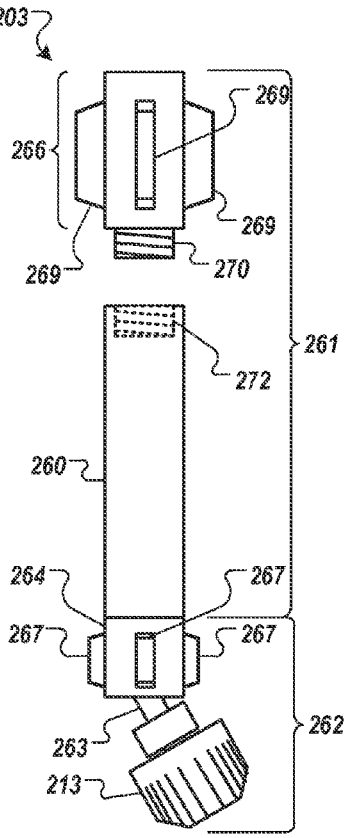
FIG. 2D is a side view of an example bottom hole assembly with an example stabilizer pad sleeve used in conjunction with a RSS tool in accordance with aspects of the present disclosure.
Figure 2C:
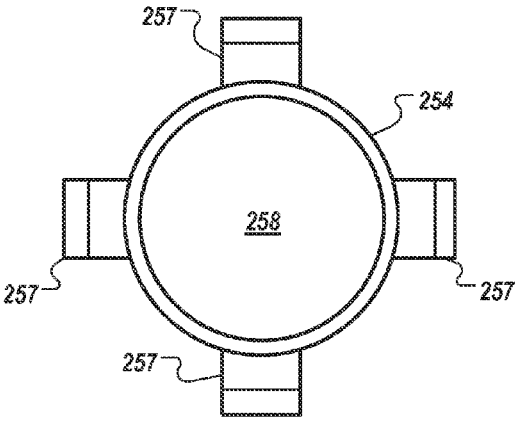
FIG. 2C is a cross section view of the example stabilizer pad sleeve of FIG. 2B.

FIG. 2C is a cross section view of an example sleeve 254 of FIG. 2B. The sleeve 254 can be formed as a cylindrical section having a central bore 258 large enough to slip over part of the bent motor housing. In the illustrated example, four of the stabilizer pads 257 are spaced at substantially equidistant radial locations about the sleeve 54. In some embodiments, other configurations can be used. For example, one, two, three, four, five, or more of the stabilizer pads 257 may be arranged in equidistant or non-equidistant radial spacings. In another example, the stabilizer pads 257 may be aligned parallel, or at other predetermined angles, to the desired trajectory of the wellbore.

FIG. 2D is a side view of an example bottom hole assembly 203 of the rotary steerable type as briefly discussed above. The BHA 203 includes an upper section 261 and a lower section 262. The upper section 261 as illustrated includes an upper stabilizer section 266 with stabilizer pads 269 and a downhole drilling motor 260. In some embodiments, the drilling motor 260 can be a positive displacement motor, such as a Moineau motor. It will be understood that in other embodiments rotation of the BHA 203 may be provided by the drill string, and a downhole motor 260 may not be included in the BHA. The lower section 262 of the BHA 203 includes a lower stabilizer section 264 with stabilizer pads 267 a rotary steerable tool 263 and a drill bit 213.

As further illustrated in FIG. 2D, the stabilizer pads 267 extend radially outward from the stabilizer section 264 positioned above the rotary steerable tool portion 263. In some embodiments (not shown), the stabilizer pads 267 can extend radially outward from a lower stabilizer section positioned below the rotary steerable tool 263. In use, the stabilizer pads 267 extend radially to contact a side wall of the wellbore. As previously discussed with regard to FIGS. 1, 2A and 2B, contact between the sidewall and the stabilizer pad 267 orients the BHA 203 at a predetermined angle, which causes the drill bit 213 or other drilling tool attached to the BHA 203 to bore in an orientation that causes a predetermined deflection (e.g., curve, dogleg) in the path of the wellbore as it is being drilled. In some embodiments, the stabilizer pads 267 and 269 may be configured and formed from materials as discussed with regard to stabilizer pads 217, 222, 257, 259 of FIGS. 2A and 2B.

The upper stabilizer section 266 may also include a connector 270. The connector 270 is formed to mate with a connector 272 formed in a housing of the motor 260. The connectors 270, 272 mate to removably affix the upper stabilizer section 266 to the motor 260. For example, the connectors 270, 272 can be threaded sections.

The BHAs 201, 202, 203 are three examples illustrated in FIGS. 2A, 2B and 2D of various combinations and embodiments of stabilizer pads and other components with BHAs, however other embodiments exist. Any appropriate combination of the upper sections 205, 251, 261, the lower sections 206, 252, 262, the motors 211, 250, 260, the drill bit 213, stabilizer pads 217, 222, 257, 259, 267, 269, the sleeve 254, and other BHA components can be assembled in any appropriate combination and in combination with other BHA components.

Figure 3:
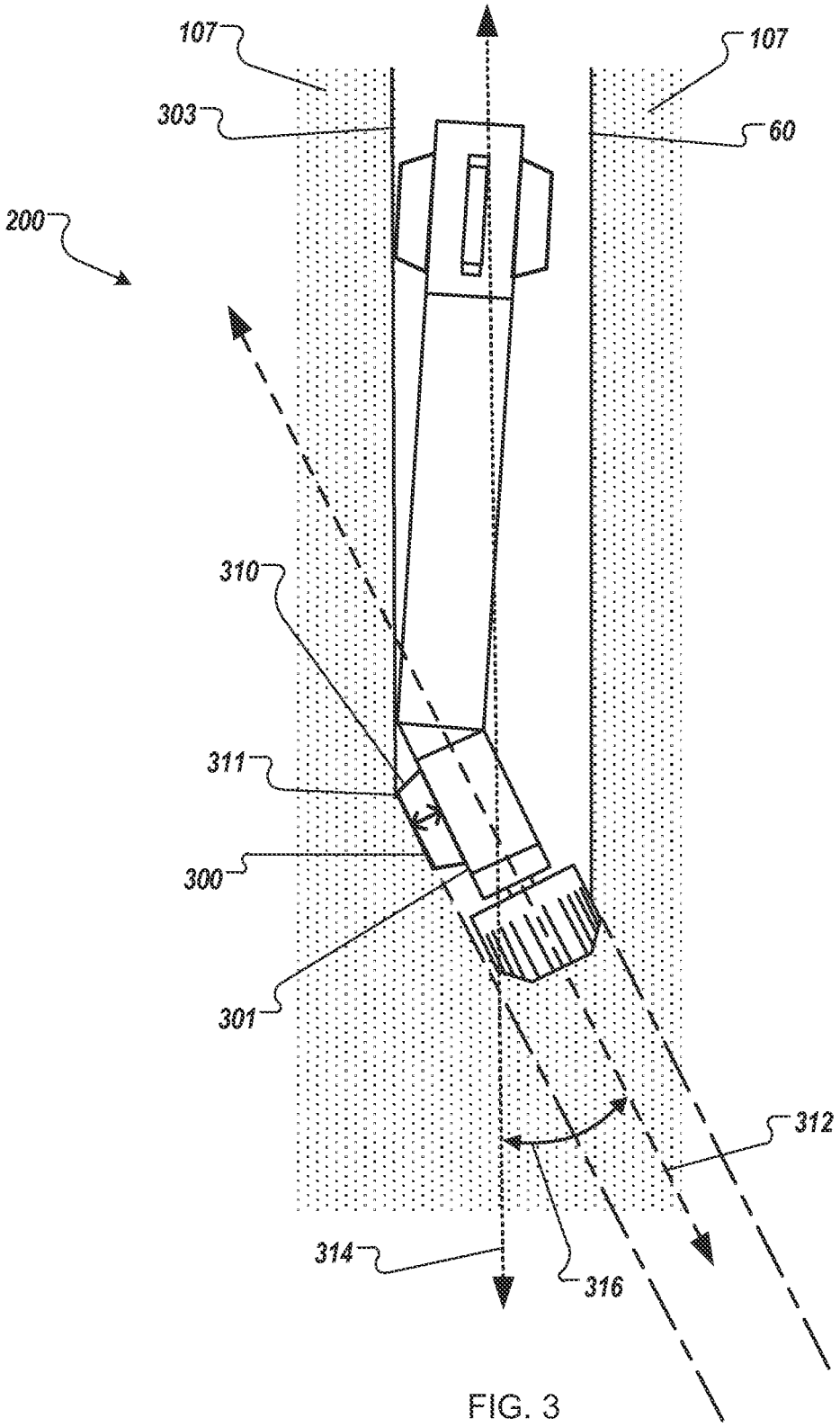
FIG. 3 is a side view of the example bottom hole assembly of FIG. 2A in a wellbore.

FIG. 3 is a side view of the example bottom hole assembly 200 of FIG. 1 including an example wearable stabilizer pad 300. In some implementations, the stabilizer pad 300 can be one of the stabilizer pads 217, 222, 257, 259, 267, 269 of FIGS. 2A-2D. The stabilizer pad 300 extends radially beyond an outer surface 301 of the BHA 200. The stabilizer pad 300 includes a thickness 310, of a material having a predetermined wear rate for strata of one or more geological formations through which the BHA 200 is expected to pass during a drilling operation. For example, the BHA 200 may be expected to pass through strata (e.g., layers of sandstone, limestone, shale deposits, or other materials), that make up regions or layers of the geological formations 107, and the stabilizer pad 300 may be made of materials (e.g., a hard facing made of tungsten carbide, steel, carbon fiber, ceramic, aluminum) having a known durability (e.g., wear resistance to abrasion) when contacting the expected strata of the geological formations. For example, steel would be expected to wear down (e.g., "X" millimeters of wear for every "Y" meters drilled or travelled) faster against granite than against a relatively softer material such as sandstone.

In use, the stabilizer pad 300 extends radially from the BHA 200 to contact a side wall 303 of the wellbore 60. For example, the stabilizer pad 300 can contact the geological formations 26 at the location indicated as a contact point 311. Contact between the sidewall and the stabilizer pad 300 orients an axis 312 of the bent motor housing and drill bit away from a central wellbore axis 314 at an initial predetermined angle 316. The predetermined angle 316 causes the drill bit or other drilling tool attached to the BHA 200 to drill in an orientation that causes a predetermined deflection (e.g., curve, dogleg) in the trajectory (path) of the wellbore 60 as the wellbore is being drilled.

Contact between the sidewall and the stabilizer pad 300 also causes wear of the stabilizer pad 300 that progressively reduces the thickness 311 of the stabilizer pad 300 and reduces the angle 316 as pad 300 wears as drilling progresses (e.g., reduces the dogleg severity). If the stabilizer pad is completely worn away during the drilling operation, the dogleg capability would be reduced to the angle of the bent motor housing as measured from a central axis of the BHA. The geometry (e.g., the thickness 311) and durability of the materials used in the stabilizer pad 300 results in a deviation of predetermined length and planned deviated wellbore trajectory for the wellbore 60. The stabilizer pad 300 imparts a two or three dimensional change in angular deviation which may increase or decrease the deviation angle 316 as measured from vertical and/or changing the azimuthal direction of the wellbore 60. It will be understood that the change in dogleg severity can be increased or decreased as the pad wears away depending on which stabilizer is designed to wear, e.g., wear on a upper stabilizer leads to an increased dog leg severity with higher inclination and wear on a lower stabilizer leads to a decrease in the dogleg severity. The process of using the stabilizer pad for directional drilling is discussed further in the descriptions of FIGS. 3-10.

The stabilizer pad 300 can be positioned on components of the BHA (e.g., bent motor housing, stabilizer assemblies, RSS tool, etc.). In some embodiments, the stabilizer pad 300 can be located on the downhole drilling motor housing. For example, bottom hole assembly (BHA) 200 can include a Moineau motor, also known as a mud motor. In some embodiments, the stabilizer pad 300 can be located on another component of the BHA positioned above the downhole drilling motor.

Figure 4A:
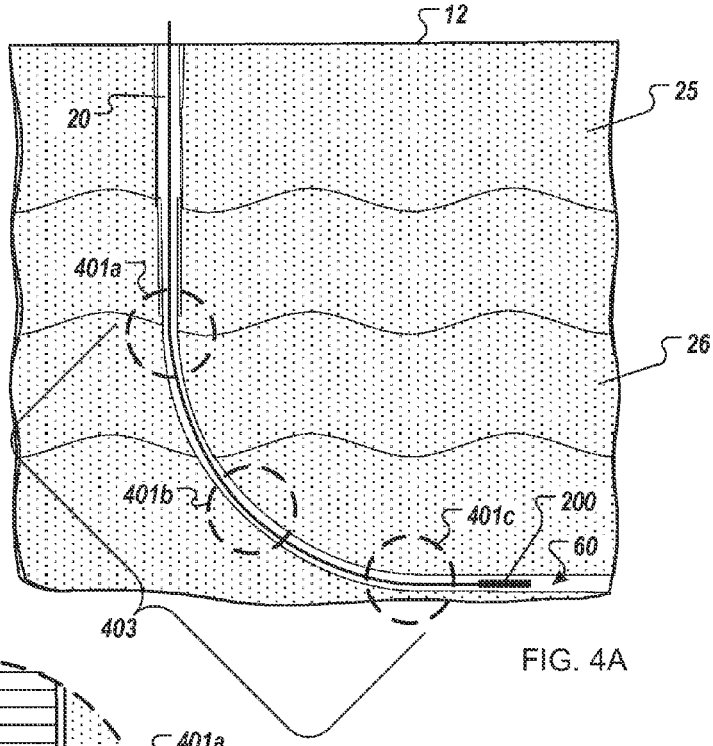
FIGS. 4A-4D show exemplary wear of a stabilizer pad during directional drilling.

FIGS. 4A-4D show example wear of an example wearable stabilizer pad 410 during directional drilling. In some embodiments, the stabilizer pad 410 can be any one of the example stabilizer pads 217, 222, 257, 259, 267, 269 or 300 of FIGS. 2A-2D and FIG. 3. Referring to FIG. 4A, the BHA 200 is lowered on the drill string 20 into and operated to form the wellbore 60 that penetrates one or more strata of one or more geological formations 25 and 26. In the implementations illustrated, from the surface 12 to a zone 401*a*, the wellbore 60 is substantially straight and vertical. The zone 401*a* is a depth at which the planned deviated wellbore trajectory begins a desired curvature in the drilling of the wellbore 60. Zones 401*b* and 401*c* are other portions of the wellbore curvature along the trajectory of the wellbore 60.

Figure 4B:
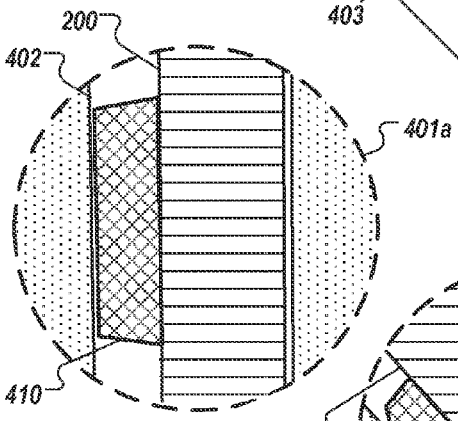

Referring now to FIGS. 4A and 4B, the zone 401*a* is shown in additional detail. At the zone 401*a*, the stabilizer pad 410 is added to the BHA 200. For example, the stabilizer pad 410 can be included with the BHA 200 in any of the embodiments discussed in the descriptions of the BHAs 201, 202, or 203. The stabilizer pad 410 extends radially outward from the BHA 200 to contact a wall 402 of the wellbore 60. The contact between the stabilizer pad 410 and the wellbore 402 causes the BHA 200 and a drill bit (e.g., the drill bit 213, not shown here), become offset as discussed in the description of FIG. 3. As drilling continues, such an offset causes the BHA 200 to deviate, forming a curve portion 403, sometimes referred to as "dogleg", or otherwise deviated section of the wellbore 60 along a predetermined planned deviated wellbore trajectory having a wellbore curvature with an expected two or three dimensional change in angular deviation (e.g., "dogleg severity") that the BHA 200 can impart on the proposed wellbore trajectory.

Figure 4C:
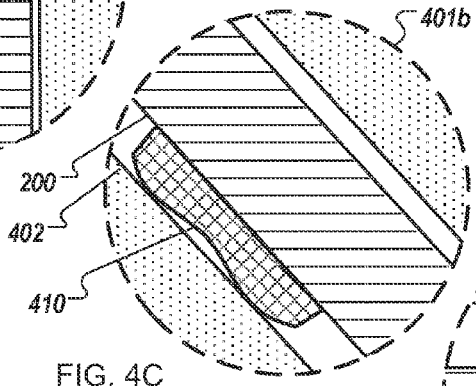

Referring now to FIG. 4C, as drilling continues, the stabilizer pad 410 is drawn along the wellbore 402. Contact between the stabilizer pad 410 and the wall 402 causes the stabilizer pad 410 to partly wear, reducing the thickness of the stabilizer pad 410.

Figure 4D:
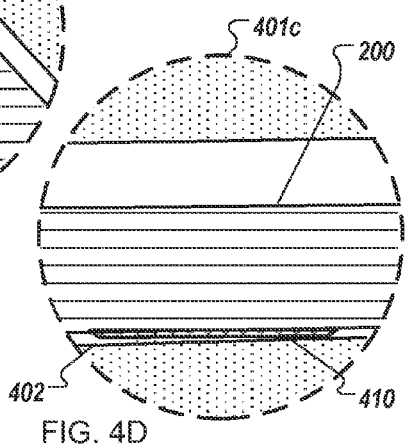

Referring now to FIG. 4D, as drilling continues, the stabilizer pad 410 becomes worn to a point where the stabilizer pad 410 no longer has a thickness that is sufficient to offset the BHA 200 and cause the BHA 200 to drill along a deviated or curved trajectory. When the stabilizer pad 410 is worn to such a reduced thickness, the drilling trajectory of the BHA 200 is determined by the bent motor housing in the BHA (if there is a bent motor housing). If there is no bent motor housing, the trajectory is aligned generally with a central axis of the BHA.

In certain embodiments, the stabilizer pad 410 can be selected based, at least in part, on its expected wear rate when exposed to strata of geologic formations 25 and 26 such that it will affect a wellbore curvature along the planned deviated wellbore trajectory. The stabilizer pad 410 may be selected based on one or more stabilizer properties which may include, but are not limited to, geometric properties, e.g., shape or thickness, and material properties, such as hardness, durability, or material composition, selected to cause the BHA 200 to drill the wellbore 60 along a predetermined simple or complex nonlinear trajectory (e.g. the deviated wellbore trajectory). In some embodiments, for example, the thickness of the stabilizer pad 410 may be selected to control the radius of curvature of the curve portion 403 (e.g., dogleg severity).

Figure 5:
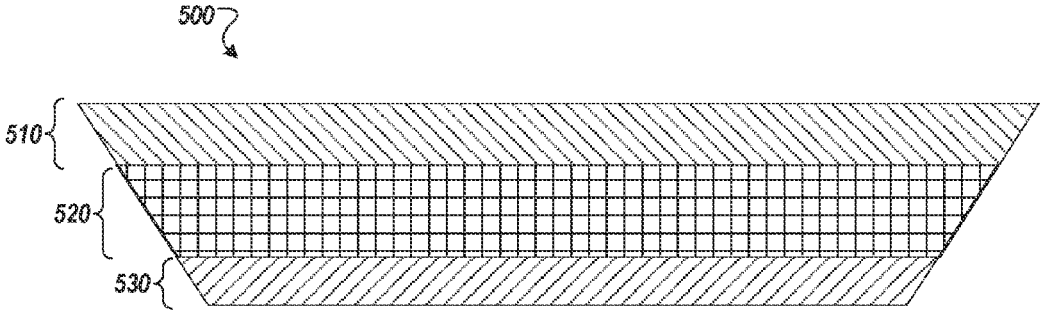
FIG. 5 is a side view of an example stabilizer pad with multiple layers.

FIG. 5 is a side view of an example wearable stabilizer pad 500 with multiple layers. In some embodiments, the stabilizer pad 500 can be one of the stabilizer pads 217, 222, 257, 259, 267, 269, 300, or 410 of FIGS. 2A-2D, 3, and 4A-4D. The stabilizer pad 500 includes a layer 510, a layer 520, and a layer 530. Each of the layers 510-530 can be formed of materials having different hardnesses, durabilities, and/or resistance to abrasion, e.g., different known rates of wear per unit of distance traveled while in contact with expected geological features found downhole. For example, ceramics, steel, tungsten carbide, aluminum, carbon fiber, copper, and any other appropriate material may be used as any one of the layers 510-530. In an exemplary embodiment a layer of tungsten carbide having a first hardness and durability may be positioned on the component of the BHA and a carbon fiber layer having a second hardness and durability less than the first layer may be positioned distally outward from the first layer. The differences in durability and hardness imparts different wearability and wear resistance properties to the individual layers 510, 520 and 530 of the pad 500 and to the composite pad 500. Additionally, in some embodiments, materials used for the layers 510-530 may be selected at least in part based on the materials' resistance to breaking off in sections during use, e.g., so large chunks of wearable material do not break off and create a potential obstruction in the wellbore. While the illustrated example shows the three layers 510-530, in other embodiments any appropriate number of layers may be used.

In use, the materials and/or thicknesses of the layers 510-530 can be selected to configure (e.g., mechanically program) the BHA 200 to drill a predetermined path (e.g., planned deviated wellbore trajectory). For example, layer 530 can be relatively hard (e.g., compared to the strata expected to be encountered by the stabilizer pad 500), layer 520 can be relatively soft, and layer 510 can be another relatively hard wear resistant layer. In such an example, layer 530 will contact a wall (e.g., the wall 402 of FIGS. 4B-4D) of the wellbore 60 first, and offset the BHA 200 and cause a first curved trajectory to be drilled for a first predetermined distance. Once the layer 530 is worn away, the layer 520 will offset the BHA 200 and cause a second curved trajectory to be drilled for a second predetermined distance. Once the layer 520 is worn away, the layer 510 will offset the BHA 200 and cause a third differently curved trajectory to be drilled for a third predetermined distance. Once the layer 510 is worn away, the BHA 200 will drill along an alignment of the bent motor housing in the BHA (if there is a bent motor housing). If there is no bent motor housing, the trajectory is dependent upon the BHA configuration, drilling parameters, and formations being drilled (e.g., tangent to the curve portions of the wellbore trajectory).

Figure 6:
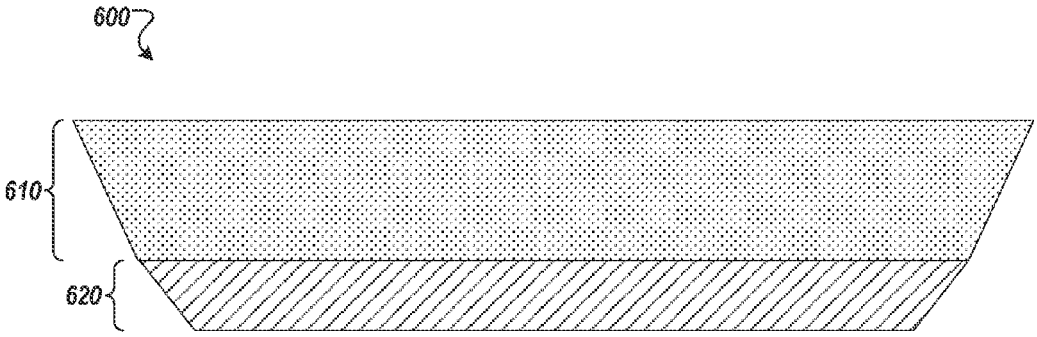
FIG. 6 is a side view of an example stabilizer blade assembly with an example stabilizer pad.

FIG. 6 is a side view of an example composite stabilizer blade assembly 600. In some embodiments, the stabilizer blade assembly 600 may be used instead of a conventional hardened stabilizer blade of a conventional downhole stabilizer. In the composite blade assembly 600 of the present disclosure a durable blade portion 610 is affixed to a conventional stabilizer. The durable portion 610 is formed of a material that is selected to arrest wear (e.g., wear minimally, wear-resistant) while in sliding contact with downhole geological formations, e.g., to function similar to a conventional stabilizer blade used on a conventional downhole stabilizer used in a BHA. The wearable stabilizer pad portion 620 is formed of a material that will wear at a predetermined rate while in sliding contact with downhole geological formations, e.g., to function like any of the stabilizer pads 210, 217, 222, 257, 259, 267, 269, 300, 410, and 500 as discussed herein. The stabilizer pad portion may be formed from materials and configured in a similar manner to the stabilizer pads 210, 217, 222, 257, 259, 267, 269, 300, 410, and 500 as discussed herein. In some embodiments, the wearable stabilizer pad portion 620 can be attached to the durable portion 610 by a catalyst bond, a resin bond, interlocking mechanical features (e.g., dovetails), fasteners, or any other appropriate attachment means.

Figure 7:
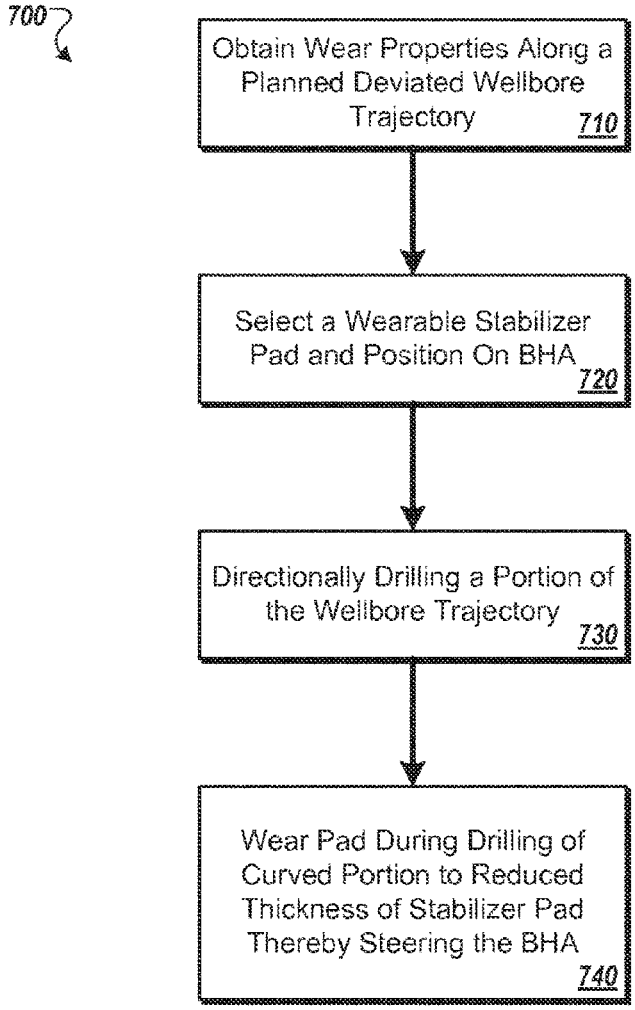
FIG. 7 is a flow diagram of an example process for directional drilling.

FIG. 7 is a flow diagram of an example process 700 for directionally drilling a wellbore along a planned deviated wellbore trajectory. In some implementations, the process 700 may be performed using the example drilling system 100 of FIG. 1, and any of the stabilizer pads 210, 217, 222, 257, 259, 267, 269, 300, 410, 500 and 620 of FIGS. 2A-2D, 3, 4A-4D, 5 and 6.

At 710, formation properties are obtained for the one or more strata in one or more geological formations through which the planned deviated wellbore trajectory will be drilled. Such properties may include unconfined rock strength, confined rock strength, abrasiveness, dip angle and grain size. The formation properties may be obtained, for example, through seismic, acoustic, and/or electromagnetic logging or surveying with respect to the formation and a borehole within a formation.

At 720, a stabilizer pad is selected such that it will wear a desired amount according to the formation properties sufficient to affect a wellbore curvature along the planned deviated wellbore trajectory. Selecting the stabilizer pad may comprise selecting between different types or designs of stabilizer pads, each with a manufactured or original thickness and a wear rate that depends, at least in part, on the formation properties. Selecting the stabilizer may also comprise selecting the thickness and wear rate and manufacturing or having manufactured a stabilizer pad that meets those specifications. As described above, the thickness and wear rate of the stabilizer pad may affect the trajectory of the deviated wellbore, and the selected stabilizer pad may be characterized by a thickness and wear rate sufficient to affect a wellbore curvature (e.g., dogleg severity) along the planned deviated wellbore trajectory geological For example, the stabilizer pad 210, 217, 222, 257, 259, 267, 269, 300, 410, 500 and 620 can be formed with a predetermined thickness, and of a material of a known hardness. When the hardness of the pad and the hardness of the subterranean strata of the geological formations 25 and 26 are obtained, an estimate of the rate of wear, e.g., units of stabilizer pad thickness lost per unit of travel of the BHA 200, can be determined. In some implementations, the thickness and wear rate can be selected to offset the BHA 200 for a predetermined distance (e.g., until the stabilizer pad wears out) corresponding to a predetermined length and radius of a curved portion of the wellbore 60 that is to be drilled. The stabilizer pad is positioned on an component of a bottom hole assembly. For example, the stabilizer pad 210, 217, 222, 257, 259, 267, 269, 300, 410, 500 and 620 can be mounted on a component of the BHA 200.

At 730, the drilling of the curve portion of the deviated wellbore trajectory is directionally steered by the wear of the stabilizer pads on the BHA. For example, the BHA 200 can be offset by the stabilizer pad 210, 217, 222, 257, 259, 267, 269, 300, 410, 500 and 620 to cause the wellbore 60 to be drilled along a two or three dimensional curved path.

At 740, the stabilizer pad is worn by contact with the strata of the geological formation to a reduced thickness such that the stabilizer has a change in dogleg capability when the curve portion of the wellbore has been drilled and the bottom hole assembly begins drilling a different portion of the wellbore below the curve portion. For example, as drilling continues along the wellbore from the zone 401*a* of FIG. 4A, to zone 401*b* and 401*c*, the stabilizer pad 410 wears down while in contact with the wall 402. At zone 401*c*, the stabilizer pad 410 is substantially worn away. Without the stabilizer pad 410 in place to cause the BHA 200 to drill along a curved trajectory, the BHA 200 will drill portions of the wellbore 60 beyond the zone 401*c* at a trajectory that is determined by the alignment of the bent motor housing in the BHA (if there is a bent motor housing). If there is no bent motor housing, the trajectory is dependent upon the BHA configuration, drilling parameters, and formations being drilled.

In some implementations, the wellbore curvature (e.g., dogleg severity) can be a measure of the predetermined expected three dimensional change in angular deviation that a bottom hole assembly can impart on a proposed wellbore trajectory. For example, two or more of the stabilizer pads 210, 217, 222, 257, 259, 267 and 269, of FIGS. 2A-2C can be used to cause the BHA to drill along the planned deviated wellbore trajectory. In some implementations, the three dimensional change in angular deviation may be increasing or decreasing the deviation angle as measured from vertical and/or changing the azimuthal direction of the wellbore.

Figure 8:
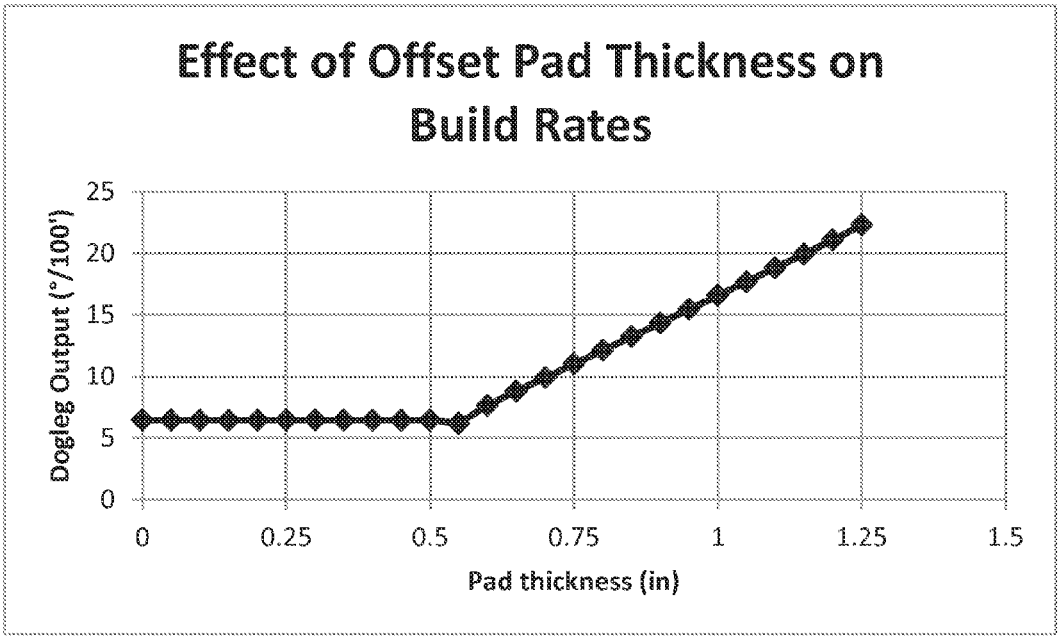
FIG. 8 is a chart showing the effects of various example stabilizer pad thicknesses on example wellbore curvatures.

FIG. 8 is a chart 800 showing the effects of various example wearable stabilizer pad thicknesses on example wellbore curvatures. The chart 800 shows that for an example BHA, a stabilizer pad having a thickness between zero and about 0.6 in. can cause a wellbore curvature of about 6 degrees per 100 ft drilled. When a greater stabilizer pad thickness is selected, a correspondingly greater wellbore curvature will be exhibited. For example, a stabilizer pad having a thickness of 1.25 in. can cause a wellbore curvature of about 22 degrees per 100 ft. drilled.

Figure 9:
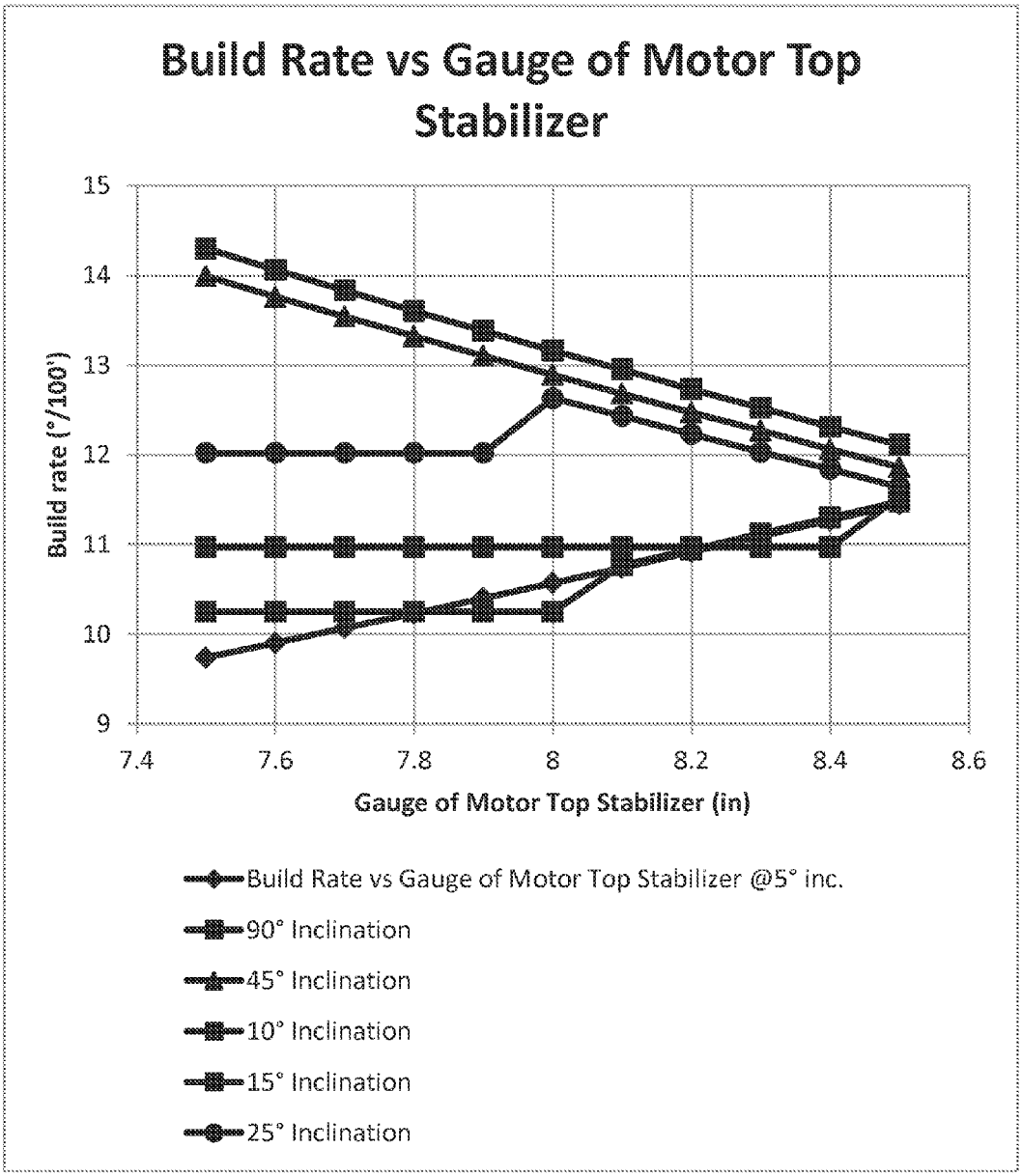
FIG. 9 is a chart showing the relationships between various stabilizer pad thicknesses at various example inclinations on example wellbore curvatures.

FIG. 9 is a chart 900 showing the relationships between various wearable stabilizer pad thicknesses at various example inclinations on example wellbore curvatures. As shown by the chart 900, the effect of pad and stabilizer thickness on wellbore curvature can be significant, and that the effects vary as inclination of the BHA changes. In some embodiments, by designing the wearable layer on the stabilizer pad to wear at a rate that corresponds to the drilling environment, a more consistent (e.g., constant) build rate (e.g., curvature, trajectory) can be achieved. For example, a relatively smoother curve may be drilled, and/or the motor may be used in drilling a tangent after drilling the curve.

Figure 10:
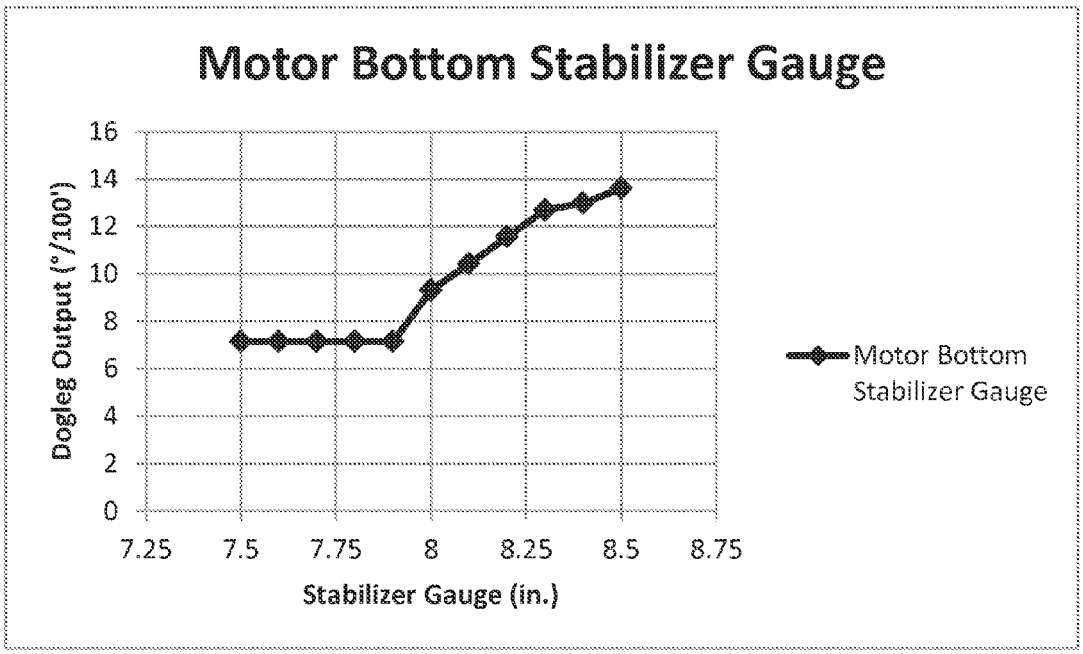
FIG. 10 is a chart showing the relationship between wear of an example stabilizer pad on an example wellbore curvature.

FIG. 10 is a chart 1000 showing the relationship between wear of an example wearable stabilizer pad on an example wellbore curvature. The chart 1000 shows that as a stabilizer pad's gauge or thickness decreases, so does the wellbore curvature. In some embodiments, relationships such as those shown in FIGS. 8-10 can be used directly or indirectly to determine thicknesses, durabilities, and/or layerings of materials to be used in the construction of stabilizer pads for various predetermined curved wellbore drilling trajectories.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method of drilling a wellbore comprising;

obtaining formation properties along a planned deviated wellbore trajectory;

selecting a stabilizer pad expected to wear a desired amount according to the formation properties sufficient to affect a wellbore curvature along the planned deviated wellbore trajectory; and drilling along the planned deviated wellbore trajectory using a bottom hole assembly with the selected stabilizer pad in contact with wellbore;

wherein selecting the stabilizer pad comprises selecting stabilizer pad properties such that the wellbore curvature of the planned deviated wellbore trajectory is within a range of 10 to 12 degrees per 100 feet when drilling through an upper strata to a lower strata.

2. The method of claim 1, wherein selecting the stabilizer pad further comprises selecting stabilizer pad properties such that the wellbore curvature of the planned deviated wellbore trajectory contains a consistent build rate over the planned deviated wellbore trajectory.

3. The method of claim 1, wherein the planned deviated wellbore trajectory comprises a three dimensional change in angular deviation.

4. The method of claim 1, further comprising selecting a material for the stabilizer pad from the group consisting of carbon fiber and ceramic.

5. A method of drilling a wellbore comprising;

obtaining formation properties along a planned deviated wellbore trajectory;

selecting a stabilizer pad expected to wear a desired amount according to the formation properties sufficient to affect a wellbore curvature along the planned deviated wellbore trajectory; and drilling along the planned deviated wellbore trajectory using a bottom hole assembly with the selected stabilizer pad in contact with wellbore;

wherein obtaining formation properties further comprises:

identifying the formation properties of a lower strata having a greater hardness than an upper strata; and selecting the stabilizer pad to wear sufficiently when drilling through the upper strata to achieve a desired curvature upon drilling through the lower strata.

6. A method of drilling a wellbore comprising;

obtaining formation properties along a planned deviated wellbore trajectory;

selecting a stabilizer pad expected to wear a desired amount according to the formation properties sufficient to affect a wellbore curvature along the planned deviated wellbore trajectory; and drilling along the planned deviated wellbore trajectory using a bottom hole assembly with the selected stabilizer pad in contact with wellbore;

wherein selecting the stabilizer pad comprises selecting one or both of a stabilizer pad geometry and a stabilizer pad thickness expected to wear a predetermined amount according to the formation properties along the planned deviated wellbore trajectory.

7. The method of claim 6, further comprising drilling directionally along the planned deviated wellbore trajectory by wearing the stabilizer pad at the predetermined amount as the stabilizer rotates and contacts the wellbore.

8. The method of claim 7, wherein wearing the stabilizer pad changes a dogleg severity of the bottom hole assembly during drilling along the planned deviated wellbore trajectory.

9. A method of drilling a wellbore comprising;

obtaining formation properties along a planned deviated wellbore trajectory;

selecting a stabilizer pad expected to wear a desired amount according to the formation properties sufficient to affect a wellbore curvature along the planned deviated wellbore trajectory; and drilling along the planned deviated wellbore trajectory using a bottom hole assembly with the selected stabilizer pad in contact with wellbore;

wherein selecting the stabilizer pad comprises selecting stabilizer pad properties such that the wellbore curvature of the planned deviated wellbore trajectory varies between 6 degrees per 100 feet and 22 degrees per 100 feet over the planned deviated wellbore trajectory; and wherein selecting the stabilizer pad further comprises selecting a stabilizer pad including at least one layer with a first durability and positioned proximal to the bottom hole assembly, and a least a second layer with a second durability that is less than the first durability.

10. A method of drilling a wellbore comprising;

obtaining formation properties along a planned deviated wellbore trajectory;

selecting a stabilizer pad expected to wear a desired amount according to the formation properties sufficient to affect a wellbore curvature along the planned deviated wellbore trajectory; and drilling along the planned deviated wellbore trajectory using a bottom hole assembly with the selected stabilizer pad in contact with wellbore;

wherein selecting the stabilizer pad comprises selecting stabilizer pad properties such that the wellbore curvature of the planned deviated wellbore trajectory varies between 6 degrees per 100 feet and 22 degrees per 100 feet over the planned deviated wellbore trajectory; and wherein selecting the stabilizer pad further comprises selecting a stabilizer pad including at least one layer of tungsten carbide hard facing positioned proximal to the bottom hole assembly, and at least one carbon fiber layer disposed on the tungsten carbide layer.

11. A directional drilling system comprising:

a bottom hole assembly having one or more stabilizer pads including one or more wearable outer portions positioned for contacting a wellbore during drilling, the wearable outer portions being configured to wear in response to contact with the wellbore during drilling, wherein the one or more stabilizer pads further comprise one or more wear-resistant inner portions radially inward of the wearable outer portions, to arrest further stabilizer pad wear beyond the wearable outer portions.

12. The directional drilling system of claim 11, wherein the wearable outer portion is secured directly to the wear-resistant inner portion.

13. The directional drilling system of claim 11, wherein a thickness of a particular stabilizer pad comprises a thicknesses of its wear-resistant radially inward portion and a thickness of its wearable outer portions.

14. The directional drilling system of claim 11, wherein the bottom hole assembly comprises a mud motor with a bent housing configured for drilling a deviated wellbore section, with the stabilizer pad positioned to affect a wellbore curvature imparted by a bent housing in drilling the deviated wellbore section.

15. The directional drilling system of claim 11, wherein the bottom hole assembly includes a rotary steerable assembly configured for drilling a deviated wellbore section wherein the stabilizer pads are positioned on the bottom hole assembly to affect a wellbore curvature imparted by a remote steerable assembly.

16. The directional drilling system of claim 11, wherein the one or more wearable outer portions of the stabilizer pad is adapted to change a dogleg severity of the bottom hole assembly during drilling of a curved portion of the wellbore.

17. The directional drilling system of claim 11, wherein the one or more wearable outer portions is formed from a material selected from the group of carbon fiber and ceramic.

18. The directional drilling system of claim 11, wherein the one or more wearable outer portions includes a first layer with a first durability and positioned proximal to the bottom hole assembly, and at least a second layer with a second durability that is greater than the first durability, said second layer positioned on the first layer distal to the bottom hole assembly.

19. The directional drilling system of claim 11, wherein the one or more wearable outer portions includes at least one layer of tungsten carbide hard facing positioned proximal to the bottom hole assembly and at least one carbon fiber layer disposed on the tungsten carbide layer distal to the bottom hole assembly.

* * * * *